US006015077A

United States Patent [19]

Disher

[11] Patent Number: 6,015,077

[45] **Date of Patent: *Jan. 18, 2000**

[54] HANDS-FREE PROTECTIVE CARRIER FOR AN UMBRELLA

[76] Inventor: Michael J. Disher, 6440 Stoneridge Mall Rd., Apt. K-116, Pleasanton, Calif. 94588

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,748

[22] Filed: Jun. 30, 1997

[51] Int. Cl.[7] ..... A45B 25/18

[52] U.S. Cl. ..... 224/666; 224/677; 224/197; 224/251; 224/915; 135/34.2

[58] Field of Search ..... 224/251, 271, 224/269, 915, 666, 667, 669, 677, 197, 200; 135/34.2; 24/669, 702, 3.12

[56] References Cited

U.S. PATENT DOCUMENTS

| | | | |
|---|---|---|---|
| D. 296,269 | 6/1988 | Richardson et al. | 224/915 |
| 1,955,436 | 4/1934 | Mott | 224/915 |
| 2,028,337 | 1/1936 | Lane | 224/915 |
| 2,373,471 | 4/1945 | Hannan . | |
| 2,545,022 | 3/1951 | Crewdson | 135/34.2 |
| 2,716,994 | 9/1955 | Torricelli . | |
| 3,561,460 | 2/1971 | Bremshey . | |
| 3,730,199 | 5/1973 | Thur . | |
| 3,744,502 | 7/1973 | Weber | 135/34.2 X |
| 3,935,874 | 2/1976 | Cohen . | |
| 4,358,036 | 11/1982 | Maltais | 224/252 |
| 4,456,023 | 6/1984 | Fujihashi . | |
| 5,323,802 | 6/1994 | Kiedrowski | 135/34.2 |
| 5,388,603 | 2/1995 | Bauer et al. . | |

FOREIGN PATENT DOCUMENTS

| | | | |
|---|---|---|---|
| 20683 | of 1895 | United Kingdom | 135/34.2 |

*Primary Examiner*—Renee S. Luebke
*Attorney, Agent, or Firm*—Morriss Bateman O'Bryant & Compagni

[57] ABSTRACT

A protective cover for enclosing an umbrella is disclosed which is structured to provide easy and quick attachment of the cover to an item of apparel so that the umbrella may be carried by the user in a hands-free manner. The protective cover of the invention is lightweight and compact, and may be structured with waterproof components for protecting the umbrella from the elements. Additionally, the cover may be structured with a material component which draws moisture away from the umbrella when placed in the cover so that formation of mold is lessened. The cover includes an attachment member which is structured to slidingly attach to an item of apparel, such as a belt on a coat, a pocket welt, a purse strap, a button, a briefcase, a backpack, or the like. In one embodiment, the attachment member may be movable relative to the stabilizing collar to enable the cover to be reduced in size and dimension for easy storage while not in use.

10 Claims, 4 Drawing Sheets

HANDS-FREE PROTECTIVE CARRIER FOR AN UMBRELLA

BACKGROUND

1. Field of the Invention

This invention relates to protective covers for umbrellas, and specifically relates to umbrella covers which may be secured to the wearer's clothing or apparel for hands-free carrying.

2. Statement of the Art

For many years the art has recognized the benefits that may be derived from covering an umbrella for storage or ease of carrying. Specifically, the art has recognized that umbrellas which are not in use tend to open, or the vanes and material fabric of the umbrella do not remain in compact formation without the aid of a device which keeps the metal vanes and material in a closed configuration. The most common device used for keeping an umbrella closed is the use of a securable strap or belt which is positioned to encircle the folds of material near the outer edge of the umbrella. Other means of maintaining an umbrella in a closed state include elongated, rigid frames comprised of rings and ribs (U.S. Pat. No. 2,373,471 to Hannan), fluted soft pocket bags sized to simulate the semi-collapsed state of the umbrella (U.S. Pat. No. 2,716,994 to Torricelli), rigid box-like sheaths (U.S. Pat. No. 3,561,460 to Bremshey, et al.), rigid tubular sheaths (U.S. Pat. No. 3,730,199 to Thor; U.S. Pat. No. 3,744,502 to Weber; and U.S. Pat. No. 4,456,023 to Fujihashi), and rigid two-piece housings integrally formed to and inseparable from the umbrella (U.S. Pat. No. 3,935,874 to Cohen).

While previously known umbrella covers adequately serve the purpose of housing an umbrella, they tend to be large and bulky, and cannot be easily or conveniently toted about while the umbrella is in use, or while the umbrella is housed in the cover. In addition, previously known covers provide no means for carrying the cover, with or without umbrella in residence, other than in the hand or slung about the wrist by means of an enlarged loop or handle attached to the cover. U.S. Pat. No. 3,561,460 to Bremshey, et al. discloses an adjustable strap which may be enlarged relative to the cover to allow the strap to be slung over the shoulder and U.S. Pat. No. 3,744,502 to Weber discloses a belt loop which allows the user to thread a belt (i.e., trouser belt or coat belt) through the loop to secure the cover to the belt. However, the latter device, providing a belt loop attachment, requires the user to either partially disrobe or dismantle his person or clothing to secure the umbrella cover to his apparel, and the former device providing a strap for slinging the cover over the shoulder or about the wrist does not eliminate the cover and umbrella from being in the way of the user's shoulder movements.

Thus, it would be advantageous in the art to provide an umbrella cover which is flexible and lightweight for ease of storage and carrying, and one which is capable of easily slipping on and off a supporting surface of the wearer's apparel for hands-free carrying of the umbrella and cover on the wearer's body. It would also be advantageous to provide a cover which is waterproof and which draws water away from the interior of the cover when the inserted umbrella is wet.

SUMMARY OF THE INVENTION

In accordance with the present invention, a cover for an umbrella is made of flexible, lightweight material and is structured with a stabilizing collar and attachment member which allows the cover to be slidingly positioned on or over a portion of wearing apparel, such as a belt, strap or button, to provide hands-free carrying of the umbrella near the wearer's body. The cover of the present invention may provide protection of the umbrella from wind, rain and snow, and may be constructed to draw moisture away from the umbrella while in the cover to avoid the formation of mold.

The cover of the present invention may preferably be structured as a flexible tubular sleeve which is sized to retain the fabric and metal vane portion of the umbrella in a closed configuration. The flexible tubular sleeve may be formed as a substantially closed tube having a closed end and an open end for insertion of the umbrella therethrough. The open end of the flexible tubular sleeve is reinforced with a stabilizing collar which facilitates insertion of the umbrella into the flexible tubular sleeve. The stabilizing collar presents an advantage over prior flexible sleeve constructions in that such prior art sleeves are so flexible that an amount of time and manual dexterity must be spent laboriously feeding the flimsy sleeve over the umbrella.

The flexible tubular sleeve may be structured to be waterproof on the exterior surface thereof to protect the umbrella within from the elements. Further, the flexible tubular sleeve may be structured to provide means within the sleeve for drawing moisture away from the umbrella. Such means facilitate drying of the umbrella within the flexible tubular sleeve and help prevent the formation of mold on the umbrella. The flexible tubular sleeve may also be structured with a space at the closed end thereof for collecting water which rolls off the umbrella, and may be structured to contain absorbent material to draw and retain moisture which runs off the umbrella. Alternatively or in addition, the closed end of the flexible tubular sleeve may be formed with perforations to allow water to exit the flexible tubular sleeve.

An attachment member is associated with the flexible tubular sleeve and may preferably be connected to the stabilizing collar. The attachment member is structured to facilitate attachment of the cover to an item of clothing worn by the user so that the cover may be carried hands-free on the user's person. Preferably, the attachment member is structured so that the attachment member may slide on or over a supporting edge or structure associated with the wearing apparel, such as a belt, a waistband, a pocket welt or a purse strap or over a support edge, strap or structure associated with an item which is carried on or about the person, such as a briefcase, suitcase, backpack or fanny pack. In an alternative embodiment, the attachment member is structured with a slot which is sized to slide over a button and to be supported thereby. Thus, the cover may be positioned to hang from a button on the front placket of a coat or from a decorative button attached elsewhere on a garment.

The attachment member may preferably be structured to be movable relative to the stabilizing collar so that the attachment member may be repositioned in a manner to reduce the overall size and dimension of the stabilizing collar and attachment member so that the cover may be stored in a pocket, purse or other convenient place about the person when the cover is not in use. So structured, the cover may be effectively reduced in size to facilitate placement of the cover in a storage place until used again.

The flexible tubular sleeve may be structured with a tab or ring positioned at or near the closed end thereof to facilitate removal of the umbrella from the cover. That is, as the umbrella is grasped with one hand, the tab or ring is held with the other hand and the cover is pulled in a direction opposite that of the umbrella. The stabilizing collar may also be structured with an absorbent component to help draw water away from the umbrella and to protect the umbrella from the elements. These, and other features of the invention, are described more fully hereinafter.

DESCRIPTION OF THE DRAWINGS

In the drawings, which currently illustrate what is considered to be the best mode of carrying out the invention.

DETAILED DESCRIPTION OF THE ILLUSTRATED EMBODIMENTS

Figure 1:
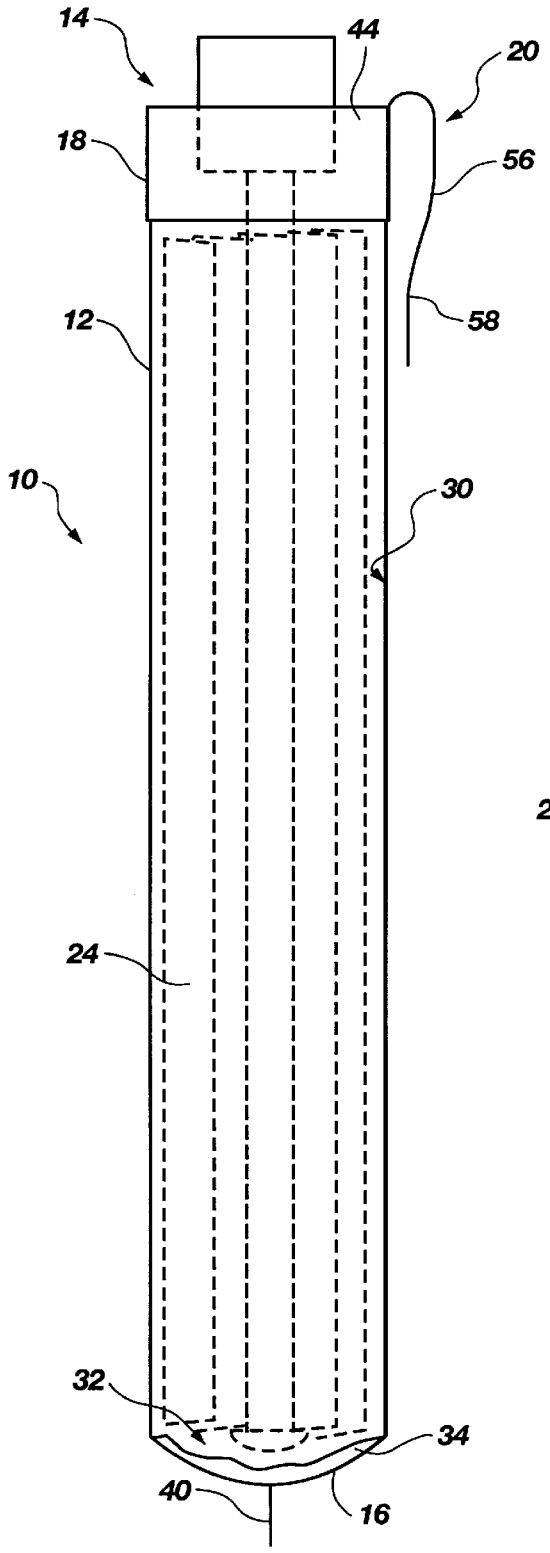
FIG. 1 is a view in elevation of the invention enclosing an umbrella shown in phantom.
Figure 2:
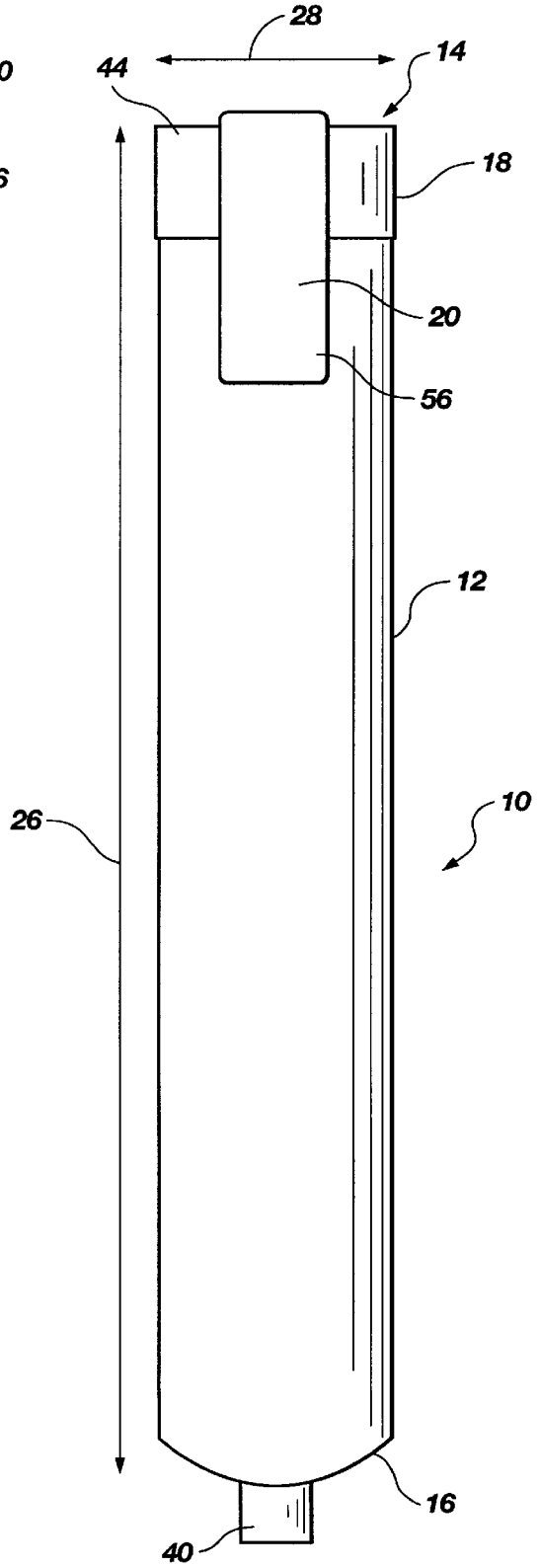
FIG. 2 is a view in elevation of the invention shown in FIG. 1 rotated about the longitudinal axis ninety degrees, and the umbrella not being shown.

The hands-free umbrella cover 10 of the present invention is shown in FIGS. 1 and 2. The cover 10 generally comprises a flexible tubular sleeve 12 having an open end 14 and a substantially closed end 16. The cover 10 also includes a stabilizing collar 18 and an attachment member 20 for securing the cover 10 to a portion of an item of apparel.

In FIG. 1, an umbrella 24 is shown, in phantom, positioned within the flexible tubular sleeve 12. The length dimension 26 of the flexible tubular sleeve may be any suitable length for accommodating either a full-length (i.e., non-collapsible) umbrella or a collapsible umbrella, but the flexible tubular sleeve 12 is preferably sized in length 26 to enclose at least the fabric and vanes portion of the umbrella, as shown. The flexible tubular sleeve 12 is also sized in diameter 28 to accommodate the circumferential dimension of the umbrella.

The flexible tubular sleeve 12 may be constructed of any suitable material or fabric which is lightweight and flexible so that the cover 10 is easy to carry about and does not present a bulky or obstructive device. In addition, the flexible tubular sleeve 12 may be made of a material which is waterproof or water-repellant, or the flexible tubular sleeve 12 may be coated on the exterior surface thereof with a substance which renders the material of the flexible tubular sleeve 12 waterproof or water-repellant. The interior surface 30 of the flexible tubular sleeve 12 which is positioned toward the umbrella 24, may be coated or lined with a material which acts to draw moisture away from the umbrella 24, or the material of the flexible tubular sleeve 12 may be inherently endowed with the ability to draw or wick moisture away from the umbrella 24. One example of such material is nylon.

Figure 3:
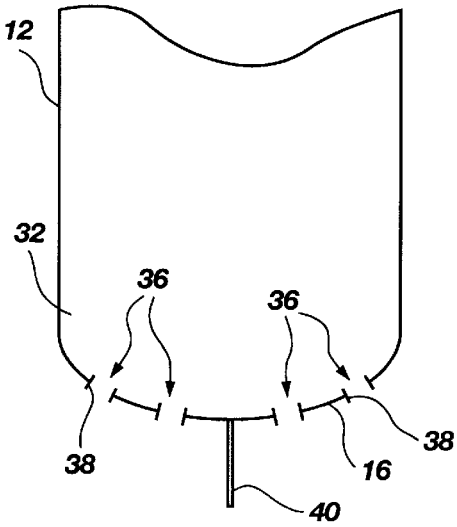
FIG. 3 is a partial view in elevation of the substantially closed end of the invention showing an alternative embodiment of the flexible tubular sleeve.

The flexible tubular sleeve 12 may be formed with an interior void 32 near the substantially closed end 16 thereof. The interior void 32 provides a space where water may accumulate as it falls from the umbrella 24 or is drawn off of the umbrella 24 to the interior surface 30 of the flexible tubular sleeve 12. The void may also contain an absorbent material 34 which draws and retains moisture which rolls off the umbrella. As shown in FIG. 1, the substantially closed end 16 of the flexible tubular sleeve 12 may be fully closed. Alternatively, as shown in FIG. 3, the substantially closed end 16 may have apertures 36 formed therethrough which allow accumulated water to drain from the flexible tubular sleeve 12. The apertures, for example, may be formed by the attachment of grommets 38 to the material of the flexible tubular sleeve 12.

The flexible tubular sleeve 12 may also be structured with a graspable member 40, such as a tab or ring, which facilitates removal of the umbrella 24 from within the flexible tubular sleeve 12. That is, because of the flexible nature of the cover 10, withdrawing the umbrella 24 from the open end 14 may cause the flexible tubular sleeve 12 to adhere to the umbrella 24 causing it to invert. This is particularly true if the umbrella 24 is wet. Therefore, the graspable member 40 allows the user to pull downwardly on the flexible tubular sleeve 12 while the umbrella is withdrawn from the open end 14 in the opposite direction.

The cover 10 of the invention includes a stabilizing collar 18 positioned at or near the open end 14 of the flexible tubular sleeve 12. The stabilizing collar 18 may, most suitably, be attached to the flexible tubular sleeve 12. The stabilizing collar 18 reinforces the open end 14 of the flexible tubular sleeve 12 and facilitates insertion of the umbrella 24 into the flexible tubular sleeve 12. The stabilizing collar 18 is preferably formed from a rigid or semi-rigid material which imparts the required stability to the open end 14 of the cover 10. It is also preferred that the material of the stabilizing collar 18 be lightweight. The stabilizing collar 18 may, most suitably, be made of a material which is either water-repellant or absorbent to direct moisture away from the open end 14 of the cover 10. Alternatively, the stabilizing collar 18 may be treated with a substance which imparts the characteristic of water-repellency or absorbency to the stabilizing collar 18.

Figure 4:
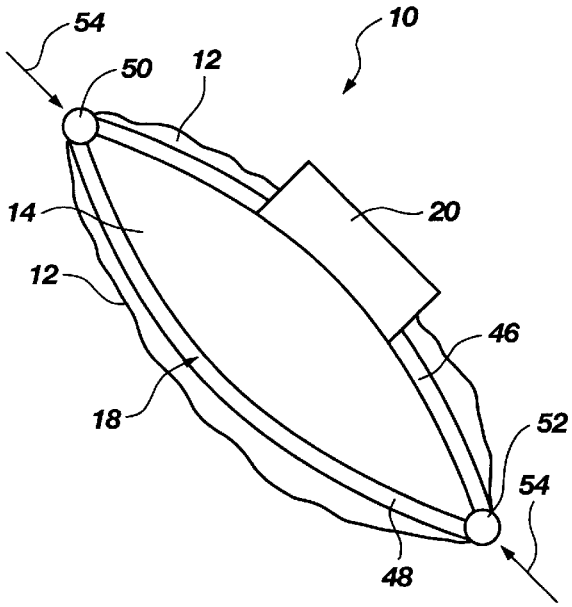
FIG. 4 is a plan view of an alternative embodiment of the stabilizing collar of the invention.

In one embodiment, the stabilizing collar 18 may be a ring 44, as shown in FIGS. 1 and 2, which is sized in circumference to receive an umbrella therethrough. The circumference of the ring 44 may be approximately equal to or smaller than a circumferential dimension of the flexible tubular sleeve 12. In an alternative embodiment shown in FIG. 4, the stabilizing collar 18 may be structured to be partially closeable to prevent rain or snow from entering into the open end 14 of the cover 10 and to provide a more slender dimension to facilitate transportation of the protective cover when it is not occupied be the umbrella. For example, the stabilizing collar 18 may be formed of two semi-rigid, but flexible, bands 46, 48 which are joined at either end thereof to a spring-biased pivot pin 50, 52. Thus, as gentle pressure is applied to the pivot pins 50, 52 in the direction of the arrows 54, the bands 46, 48 are forced apart from each other thereby increasing the width of the open end 14 to permit insertion of the umbrella into the flexible tubular sleeve 12. When pressure is released from the pivot pins 50, 52, the bands 46, 48 are urged toward each other by force of the spring-biased pivot pins 50, 52 so that the open end 14 becomes fully or partially closed.

Many alternative means exist for structuring a stabilizing collar 18 that remains in a normally closed position as described and such alternative means are considered within the scope of the invention. Such means may include, for example, a stabilizing collar made of a unitary portion of flexible plastic which is pre-formed in a flattened ring, the ends of which are depressible, as previously described with respect to the embodiment shown in FIG. 4, to open the ring for insertion of the umbrella. A stabilizing collar 18 so made would avoid the use of springs and the like.

The cover 10 of the present invention also includes an attachment member 20 which is structured to slidingly fit over a portion of an item of wearing apparel, such as a belt, purse strap or button. One example of an attachment member 20 which provides sliding attachment is shown in FIGS. 1 and 2 as a rigid clip 56 which is secured to the stabilizing collar 18 and extends generally from the open end 14 of the cover 10 to a distance below the stabilizing collar 18. The downwardly extending portion 58 of the clip 56 may also be generally parallel to the longitudinal axis of the flexible tubular sleeve 12. An attachment member 20 like the clip 56 shown in FIGS. 1 and 2 allows the cover 10 to be easily and quickly slid over a portion of the user's apparel, such as a trouser belt, coat belt, pocket welt, purse strap, or any other suitable place, including a backpack, fanny pack, soft briefcase, carrier bag, or the like. The cover may be removed as easily from its supported position on the apparel, or other worn or carried item, and does not require an investment of time and effort to attach or detach the cover 10 from the item of apparel as required in prior art devices.

Figure 5:
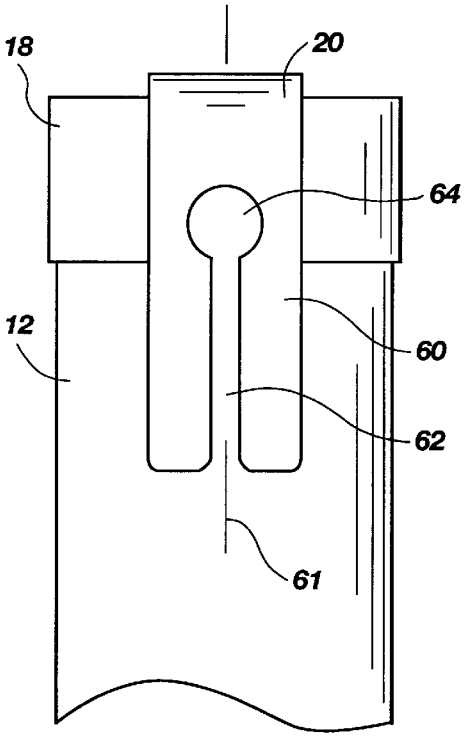
FIG. 5 is a partial view in elevation of the invention showing an alternative embodiment of the attachment member.
Figure 6:
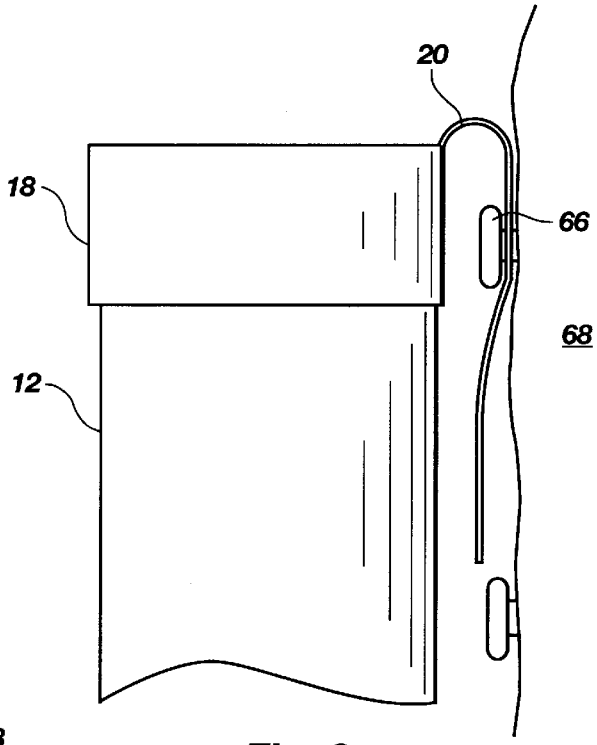
FIG. 6 is a partial view in elevation of the invention shown in FIG. 5 rotated about the longitudinal axis ninety degrees and illustrating attachment of the invention to a button on a garment.

In an alternative embodiment shown in FIGS. 5 and 6, the attachment member 20 may be formed as a clip 60 having a slot formed along the long axis 61 of the clip 60 and, optionally, a keyhole 64 may be provided at the closed end of the slot 62. As configured, the clip 60 may be slid over the threads of a button 66, as shown in FIG. 6, so that the button retains the cover 10 in position on an item of apparel, such as a coat 68 or jacket. Again, the cover 10 may be slid off the button 66 with equal ease and speed.

To facilitate easy storage of the cover 10 when not in use, the cover 10 may be structured in such a manner as to reduce the overall size and dimension thereof to render it more compact and more easily stored in a purse, pocket or other temporary storage niche. Thus, for example, as shown in FIGS. 7 and 8, the attachment member 20 may be movable (e.g., rotatable) relative to the stabilizing collar 18 to position the attachment member 20 in parallel orientation with the lateral axis (i.e., perpendicular to the longitudinal axis through the cover 10) of the stabilizing collar 18. The flexible tubular sleeve 12 may then be wrapped about the stabilizing collar 18 and attachment member 20 (in parallel orientation to the stabilizing collar 18) to reduce the overall size and dimension of the cover 10 for storage.

Figure 7A:
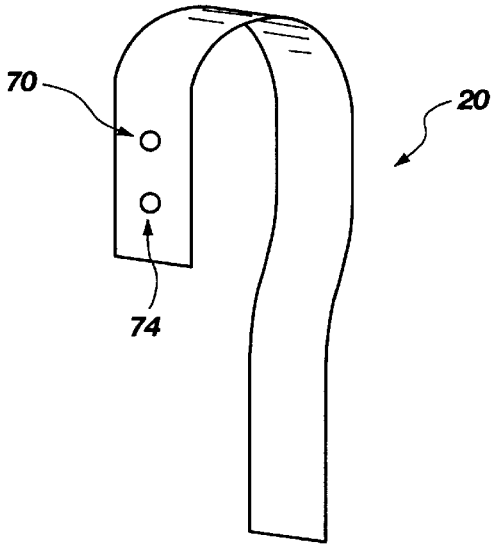
FIG. 7A illustrates one embodiment of the present invention where the attachment member is structured to rotate relative to the stabilizing collar for effecting a reduced size and dimension of the invention.
Figure 7B:
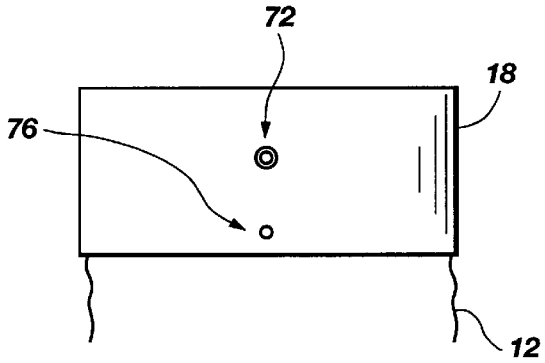
FIG. 7B illustrates a stabilizing collar configured with means for pivotally attaching the attachment structure shown in FIG. 7A thereto.
Figure 7C:
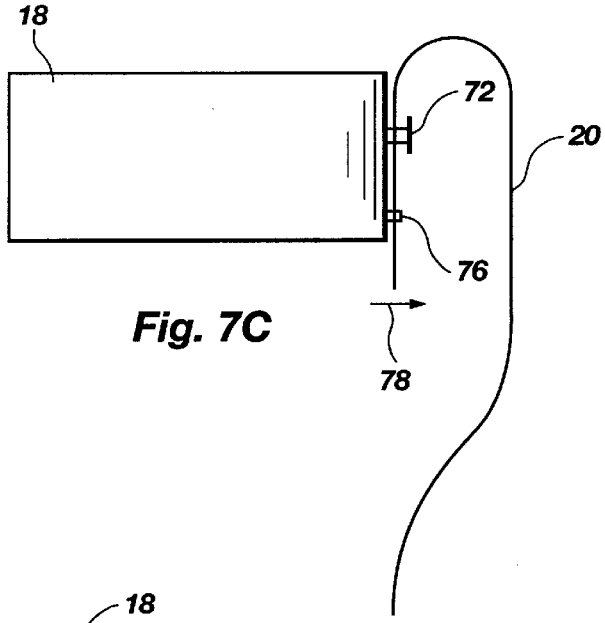
FIG. 7C illustrates the stabilizing collar of FIG. 7B with the attachment structure pivotally attached thereto and positioned for securement of the stabilizing collar to a supporting surface.
Figure 7D:
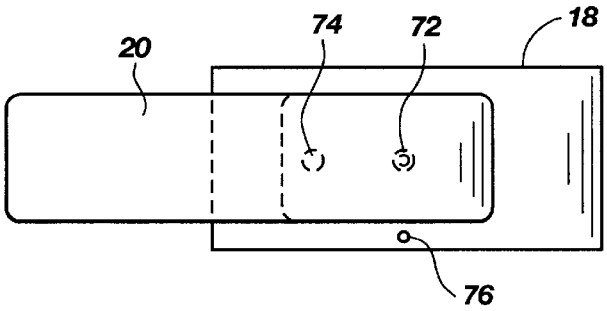
FIG. 7D illustrates the attachment structure of FIG. 7A pivotally moved relative to the stabilizing collar for storage of the umbrella holder.

One means of moving the attachment member 20 relative to the stabilizing collar 18 is shown in FIGS. 7A–D. In FIG. 7A, the attachment member 20 is shown being formed with a first aperture 70 sized to receive a shaft 72 attached to the stabilizing collar 18, as shown in FIGS. 7B and 7C. The attachment member 20 is also formed with a second aperture 74, spaced from the first aperture 70, which is sized to receive a securement pin 76 which is also attached to the stabilizing collar 18. As shown in FIG. 7C, the attachment member 20 is pivotally secured to the stabilizing collar 18 by shaft 72 about which the attachment member 20 is pivotally movable. The attachment member 20 is maintained in position perpendicular to the lateral axis of the stabilizing collar 18 by positioning of the securement pin 76 through the second aperture 74, as shown in FIG. 7C. When the cover 10 is to be readied for storage, the attachment member 20 may be urged slightly away from the stabilizing member 18, in the direction of arrow 78, to disengage the securement pin 76 from the second aperture 74, thereby allowing the attachment member 20 to rotate freely about the shaft 72. The attachment member 20 may then be rotated until it is oriented parallel to the stabilizing collar 18, as shown in FIG. 7D. Alternatively, the securement pin 76 may, for example, be spring biased and may be depressed in the direction of the stabilizing collar 18 to disengage the securement pin 76 from the second aperture 74, thereby allowing the attachment member 20 is rotate freely about the shaft 72.

Figure 8B:
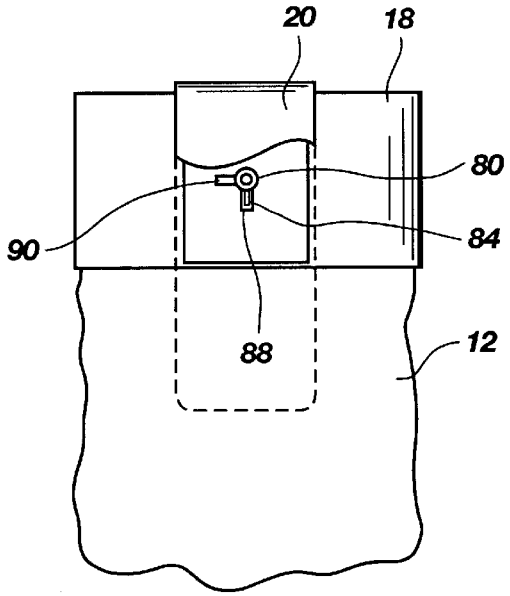
FIG. 8B illustrates the attachment member of FIG. 8A positioned for securement to a supporting surface.
Figure 8C:
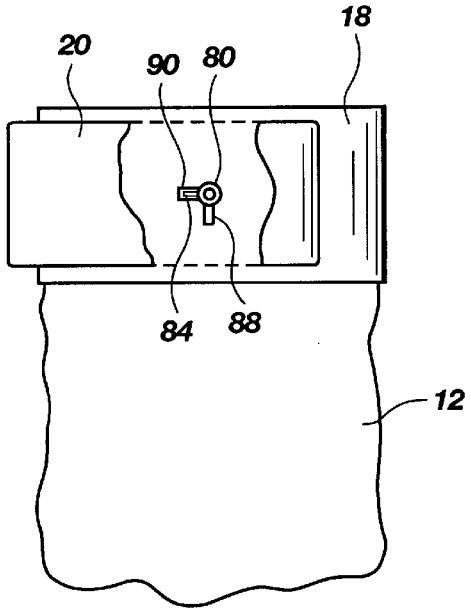
FIG. 8C illustrates the attachment member of FIG. 8A positioned for storage.
Figure 8A:
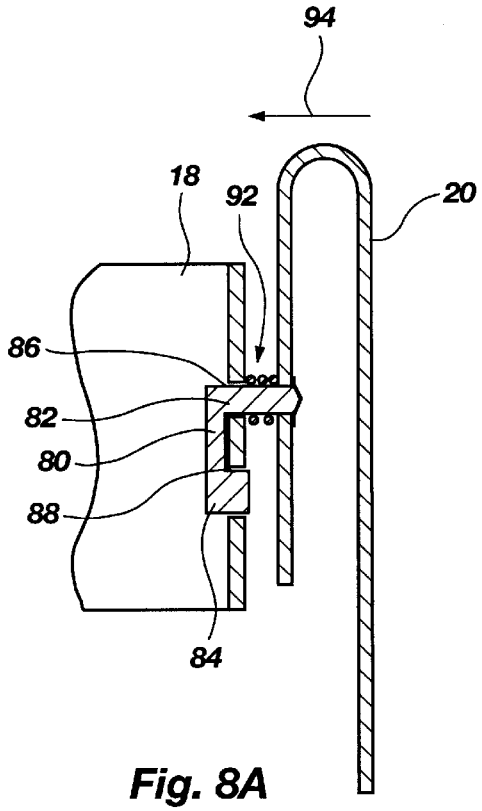
FIG. 8A illustrates an alternative embodiment for moving the attachment member relative to the stabilizing collar using a detent mechanism.

FIGS. 8A–8C illustrate yet another means for providing rotation of the attachment member 20 relative to the stabilizing collar 18. In the embodiment shown in FIG. 8A, the attachment member 20 may be pivotally attached to the stabilizing collar 18 by an L-shaped pin 80 having a main shaft 82 and a key tab 84. The main shaft 82 is positioned through a first aperture 86 formed through the stabilizing collar 18 and is fixedly secured to the attachment member 20. The key tab 84 extends in a direction parallel to the main shaft 82 and is alternately positionable in one of two apertures 88 and 90 (FIG. 8B) positioned in proximity to the first aperture 86. A spring 92 is positioned about the main shaft 82 and is biased between the stabilizing collar 18 and the attachment member 20 to keep the key tab 84 secured in position within one of the two apertures 88 or 90. Thus, as shown in FIGS. 8A and 8B, when the attachment member is oriented perpendicularly to the stabilizing collar 18 as it would be for normal use, the key tab 84 is positioned in aperture 88 and is held in place by force of the spring 92. When the attachment member 20 is to be rotated to bring it into parallel orientation with the stabilizing collar 18, the attachment member 20 is pushed, in the direction of arrow 94, toward the stabilizing collar 18 which compresses the spring 92. With compression of the spring 92, the main shaft 82 moves in the same direction, as does the key tab 84 and the key tab 84 is moved out of registration with the aperture 88. The attachment member 20 is then free to rotate relative to the stabilizing collar 18 by rotation of the main shaft 82 in the first aperture 86. When the attachment member 20 is rotated ninety degrees so that it is parallel to the stabilizing collar 18, the key tab 84 is in alignment with aperture 90, and a release of pressure from the attachment member 20 allows the spring 92 to be biased once again between the stabilizing collar 18 and the attachment member 20, and the key tab 84 is secured in place within the aperture 90, as shown in FIG. 8C. Many alternative means of structuring the invention may be employed to accomplish the objective of positioning the attachment member 20 in orientation to the stabilizing collar 18 so that the stabilizing collar 18 and attachment member 20 present a smaller size and dimension for storage.

The umbrella cover of the present invention is specifically structured to provide a means for supporting the umbrella on an item of apparel so that the user's hands may be free for movement or holding of other items. In addition, the umbrella cover is structured to provide ease of attachment of the cover to an item of apparel so that the user may avoid having to string the cover onto a belt or other piece of clothing, or may avoid having to adjust some aspect of the cover, such as a strap, to fit over the user's shoulder or the like. The mode and manner of carrying out these particular objectives are many. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A hands-free umbrella carrier configured for retaining an umbrella on a user's apparel or about a user's body comprising:

a flexible tubular sleeve sized to receive and enclose an umbrella, said flexible tubular sleeve having an open end for receiving an umbrella and an entirely flexible closed end;

a stabilizing collar attached to said open end of said flexible tubular sleeve to provide an opening to said flexible tubular sleeve, said stabilizing collar having at least two bands of semi-flexible material joined at their respective ends by spring-loaded pivot pins which operate to move the bands relative to each other to provide a first open position and a second closed position, the movement of said bands being achievable by manipulation with one hand; and an attachment member positioned on said stabilizing collar constructed to slidingly attach to a supporting surface for carrying the hands-free carrier near a wearer's body, said attachment member being rotatably secured to said stabilizing collar in a manner whereby said attachment member may be selectively adjusted from a position perpendicular to said stabilizing collar for enabling insertion of an umbrella into said flexible tubular sleeve while said flexible tubular sleeve is attached to a user's apparel to a second position in parallel alignment with said stabilizing collar to thereby provide a smaller size and dimension of said stabilizing collar and attachment member for storage of said umbrella carrier.

2. The hands-free umbrella carrier of claim 1 further comprising a graspable member positioned on said closed flexible end of said flexible tubular sleeve and distanced from said stabilizing collar to facilitate withdrawal of said umbrella from an tubular sleeve.

3. The hands-free umbrella carrier of claim 2 wherein said flexible tubular sleeve is configured with a space at a lowermost point of said flexible closed end for collecting moisture.

4. The hands-free umbrella carrier of claim 3 further comprising material positioned in said space to draw and retain moisture therein.

5. The hands-free umbrella carrier of claim 3 wherein said flexible tubular sleeve is comprised of a waterproof material.

6. The hands-free umbrella carrier of claim 5 wherein said flexible tubular sleeve is formed with a material on an interior surface thereof which wicks moisture away from an umbrella positioned in the flexible tubular sleeve.

7. The hands-free umbrella carrier of claim 1 wherein said stabilizing collar is constructed with an absorbent material component.

8. The hands-free umbrella carrier of claim 1 wherein said attachment member is constructed with a slot sized to receive a button therethrough for positioning said umbrella carrier on the button of a wearer's apparel.

9. A hands-free umbrella carrier configured for retaining an umbrella on a user's apparel or about a user's body comprising:

a flexible tubular sleeve sized to receive and enclose an umbrella, said flexible tubular sleeve having an open end for receiving an umbrella and a closed, entirely flexible end having no hardened structures positioned at said closed, entirely flexible end;

a space located at a lowermost point of said closed, entirely flexible end of said flexible tubular sleeve for collecting moisture;

material positioned in said space to draw and retain moisture therein;

apertures formed through said flexible tubular sleeve in proximity to said space for drainage of liquid from said tubular sleeve;

a stabilizing collar attached to said open end of said flexible tubular sleeve to provide an opening to said flexible tubular sleeve; and an attachment member positioned on said stabilizing collar and constructed to slidingly attach to a supporting surface for carrying the hands-free carrier near a wearer's body.

10. The hands-free umbrella carrier of claim 9 further comprising a graspable member positioned on said flexible tubular sleeve and distanced from said stabilizing collar.

* * * * *